US007061377B1

(12) United States Patent
Kraus

(10) Patent No.: US 7,061,377 B1
(45) Date of Patent: Jun. 13, 2006

(54) ALARM SYSTEM

(75) Inventor: Albert John Kraus, 578 Eagle Perch Pl., Henderson, NV (US) 89012

(73) Assignee: Albert John Kraus, Henderson, NV (US)

( * ) Notice: Subject to any disclaimer, the term of this patent is extended or adjusted under 35 U.S.C. 154(b) by 68 days.

(21) Appl. No.: 10/746,191

(22) Filed: Dec. 26, 2003

(51) Int. Cl.
*G08B 13/08* (2006.01)

(52) U.S. Cl. ..... 340/545.6; 340/545.1; 340/569

(58) Field of Classification Search ..... 340/545, 340/545.1, 545.6, 545.7, 569, 545.8
See application file for complete search history.

(56) References Cited

U.S. PATENT DOCUMENTS 4,583,081 A 4/1986 Schmitz ..... 340/686.6
4,868,543 A * 9/1989 Binkley ..... 340/569
5,402,105 A 3/1995 Doyle et al. ..... 340/539.22
5,499,014 A 3/1996 Greenwaldt ..... 340/539.11
5,781,107 A 7/1998 Ji ..... 340/545.1
5,883,579 A 3/1999 Schreiner et al. ..... 340/686.1
6,831,558 B1 * 12/2004 Andrew ..... 340/539.2

* cited by examiner

*Primary Examiner*—Donnie L. Crosland

(57) ABSTRACT

A door/window/mailbox alarm system comprising a switch, a transmitter unit, a receiver unit and a warning means. A user is reminded to check and close an opened door/window/mailbox by the warning means on the receiver unit which is located away from the door/window/mailbox and in a close proximity to the user's active area such that the user could see or hear a warning signal from the warning means easily. The transmitter unit comprises a timer device that enables the transmitter unit to send out a preset signal every "x" amount of seconds to the receiver saying the door/window/mailbox is still open and serves as a reminder.

18 Claims, 3 Drawing Sheets

ALARM SYSTEM

TECHNICAL FIELD OF THE INVENTION

The present invention relates generally to an alarm device that can be used with any door, window, or mailbox in a domestic or commercial property signaling that the door, window or mailbox or any other aperture is open or has been opened. The alarm system will continuously alert a person, at adjustable preset times, until they cancel the alarm or until the aperture has been closed and the alarm has been reset.

BACKGROUND OF THE INVENTION

The present invention relates to an alarm system. It can be appreciated that alarm systems have been in use for many years and examples of such are described below.

An alarm system is shown in U.S. Pat. No. 4,583,081 issued Schmitz and published on Apr. 15, 1986. This document shows a door operator system includes up and down limit switches actuated to the closed position when the door reaches the up and down travel limits. A processor circuit within the operator is connected to the limit switches for ascertaining the position of the door. Bias circuits apply a bias to the processor when the limit switches are open. An indicator system comprising a pair of light emitting diodes connected across respective limit switches which indicates the door position. A series impedance element common to both LED circuits prevents actuation of the control circuit by the light emitting devices.

Another alarm system is shown in U.S. Pat. No. 5,402,105 issued to Doyle et al, published Mar. 28, 1995 relates to a garage door position indicating system including a tilt switch attached to a garage door, an RF transmitter coupled to the tilt switch, an RF receiver, and an indicator controlled by the RF receiver. The tilt switch supplies an enable signal to the RF transmitter at selected first tilt positions and blocks the enable signal at selected second tilt positions. The RF transmitter generates an RF signal in response to the enable signal. The RF receiver is responsive to the RF signal and controls an indicator to indicate the position of the garage door.

U.S. Pat. No. 5,499,014 issued to Greenwaldt, published Mar. 12, 1996 relates to a security alarm system includes a wireless transmitter unit, a portable control unit, and a receiver unit. The transmitter unit includes a sensor for detecting the opening of a door or window to a protected area and an alarm signal generator for providing an alarm signal wherein the alarm signal generator is controlled by the sensor. The control unit includes an arm signal generator for providing and transmitting an arm signal and a disarm signal generator for providing and transmitting a disarm signal. The receiver unit includes an alarm for indicating unauthorized opening of the door or window to the protected area, a first circuit for receiving the alarm signal from the transmitter unit and activating the alarm when the alarm is armed, a second circuit for receiving the arm signal from the control unit and arming the alarm, and a third circuit for receiving the disarm signal from the control unit and disarming the alarm and for turning the alarm off when the alarm is activated.

U.S. Pat. No. 5,781,107 issued to Ji, Wen Shu and published Jul. 14, 1998 relates to an alarm device for an automatic garage door including a detecting circuit for producing a single negative pulse signal when a detector detects an opening motion of said garage door, an alarm controlling circuit for receiving said single negative pulse signal and producing an alarm signal, a "normal function" detecting circuit connecting to a garage door opening machine for producing a "normal opening" signal when said garage door is normally opened by said garage door opening machine, which is then changed to a "shut off alarm" signal provided to said alarm controlling circuit for preventing the production of said alarm signal, an alarm generating circuit for generating an alarm when said alarm signal is received, and a transformer circuit for providing low voltage for said alarm device. Accordingly, the alarm device for an automatic garage door can provide a warning alarm when said garage door is forced to open or damaged by bandits or burglars. However, as long as the residents operate a normal remote control or in-house switch of said garage door to open or close it, said garage door will be opened and closed as usual with no alarm.

U.S. Pat. No. 5,883,579 issued to Schreiner and Schofield published Mar. 16, 1999 relates to a system which will activate an alarm when a garage door is opened. The system consists of a transmitter unit and a receiver unit. The transmitter unit is attached in proximity to the garage door. The receiver unit is located within a vehicle stored in the garage. The transmitter unit includes a signal generator which activates and transmits radio frequencies (RF) to the second unit. For activation, once the garage door is in an opened position, the transmitter sends a signal to the receiver. The receiver activates an alarm.

In WO02100222 issued to Dalgaard Allan (DK) published Dec. 19, 2002 discloses a radio-signal-based mail delivery alarm system comprising a transmitter unit provided in connection with a mailbox or mail-slot flap and a receiver unit for being located at a distance from the transmitter unit and being able to receive a radio signal emitted by the transmitter unit. The transmitter unit comprises a movement sensor for detecting movement of the mailbox or mail-slot flap and a transmitter with power supply and antenna for emitting a radio signal in response to movement of the mailbox or mail-slot flap. As opposed to the prior art transmitter units for such mail delivery alarm systems, the present transmitter unit is built integrally with the mailbox or mail-slot flap.

OBJECTS OF THE INVENTION

The main object of the invention is to provide a system to tell a user that their mail has arrived, a door is open or a window is open and to continuously remind a user at adjustable preset times. The invention provides an alarm system that reminds someone that their door, window, or mailbox etc is still open until the alarm has been reset.

Doors, windows and mailboxes can easily be left open, for example, someone can easily forget to close the garage door as the door can't be seen from inside the house, or a window is often left open just a bit to cool an area. The invention provides an alarm that will continuously alert a person, at preset intervals that can be set by the person, that a door or window etc is open. This alarm will repeat until the door or window or mailbox has been shut and the alarm reset.

The object of the invention is to provide a mailbox status indicating system used in combination with a mailbox, the indicating system comprising a contact means secured to the aperture of the mailbox, a first device and a second device; the first device comprising a switch and a transmitter unit, the switch is electrically coupled to the transmitter unit. The switch is mounted in close proximity to the aperture of the mailbox and aligned with the contact means. The second device comprises a receiver unit and a warning means, the receiver unit is electrically coupled to the warning means. The second device is used for reminding a user to check and close the opened mailbox and is located away from the mailbox and in a close proximity to the user's active area such that the user could see or hear a warning signal from the warning means easily. The second device is only activated upon the sensed of the presence of the user by a motion sensor. The transmitter unit includes a transmitting means for transmitting signals and the receiver unit includes a receiving means for receiving transmitted signals, the contact means contacts and closes the first switch when the mailbox is in an opened position for rendering current to travel to the transmitter unit, transmits signals to said receiver unit, and the received signals are received via the receiving means for activating the warning means. The transmitter unit comprises a timer device that enables the transmitter unit to send out a preset signal every "x" amount of seconds to the receiver saying the mailbox is still open and serves as a reminder.

Another object of the invention is to provide a mailbox status indicating system wherein the transmitting means is a signal generator.

Another object of the invention is to provide a mailbox status indication system wherein the receiving means is a radio frequency receiver.

Another object of the invention is to provide a mailbox door status indication system wherein the receiving means is a radio frequency receiver.

Another object of the invention is to provide a mailbox door status indication system wherein the contact means is a mailbox door switch bracket, and the mailbox door switch bracket is vertically aligned with said first switch.

Another object of the invention is to provide a window status indicating system used in combination with a window, the indicating system comprising a contact means secured to the aperture of the window, a first device and a second device; the first device comprising a switch and a transmitter unit, the switch is electrically coupled to the transmitter unit. The switch is mounted in close proximity to the aperture of the window and aligned with the contact means. The second device comprises a receiver unit and a warning means, the receiver unit is electrically coupled to the warning means. The second device is used for reminding a user to check and close the opened window and is located away from the window and in a close proximity to the user's active area such that the user could see or hear a warning signal from the warning means easily. The second device is only activated upon the sensed of the presence of the user by a motion sensor.

The transmitter unit includes a transmitting means for transmitting signals and the receiver unit includes a receiving means for receiving transmitted signals, the contact means contacts and closes the first switch when the window is in an opened position for rendering current to travel to the transmitter unit, transmits signals to said receiver unit, and the received signals are received via the receiving means for activating the warning means. The transmitter unit comprises a timer device that enables the transmitter unit to send out a preset signal every "x" amount of seconds to the receiver saying the mailbox is still open and serves as a reminder.

Another object of the invention is to provide a window status indicating system wherein the transmitting means is a signal generator.

Another object of the invention is to provide a window status indication system wherein the receiving means is a radio frequency receiver.

Another object of the invention is to provide a window status indication system wherein the receiving means is a radio frequency receiver.

Another object of the invention is to provide a window status indication system, wherein the contact means is a bracket, and said bracket is vertically aligned with said first switch.

Another object of the invention is to provide a door status indicating system used in combination with a door, the indicating system comprising a contact means secured to the aperture of the door, a first device and a second device; the first device comprising a switch and a transmitter unit, the switch is electrically coupled to the transmitter unit. The switch is mounted in close proximity to the aperture of the door and aligned with the contact means. The second device comprises a receiver unit and a warning means, the receiver unit is electrically coupled to the warning means.

The second device is used for reminding a user to check and close the opened door and is located away from the door and in a close proximity to the user's active area such that the user could see or hear a warning signal from the warning means easily. The second device is only activated upon the sensed of the presence of the user by a motion sensor. The transmitter unit includes a transmitting means for transmitting signals and the receiver unit includes a receiving means for receiving transmitted signals, the contact means contacts and closes the first switch when the door is in an opened position for rendering current to travel to the transmitter unit, transmits signals to said receiver unit, and the received signals are received via the receiving means for activating the warning means. The transmitter unit comprises a timer device that enables the transmitter unit to send out a preset signal every "x" amount of seconds to the receiver saying the mailbox is still open and serves as a reminder.

Another object of the invention is to provide a door status indicating system wherein the transmitting means is a signal generator.

Another object of the invention is to provide a door status indication system wherein the receiving means is a radio frequency receiver.

Another object of the invention is to provide a door status indication system wherein the receiving means is a radio frequency receiver.

Another object of the invention is to provide a door status indication system wherein the contact means is a door switch bracket, and the door switch bracket is vertically aligned with the first switch.

Another object of the invention is to provide a mailbox/door/window status indication system wherein the warning means can be visual for example a series of lights and/or audible for example a voice signal, a bell or a chime or other suitable sound.

A particular advantage of this invention over the prior art is seen in the mailbox application. Most US mailboxes are located where the front yard meets the road and/or in a series of stack boxes in a rental complex. In the US theft from mailboxes is quite high. So, when someone opens the mailbox, from the tone inside the house or the visual indication, the residents know someone has gone inside one's box. In the prior art mailbox alarms are normally separate from the alarm systems in the property. The present invention can be integrated into this system.

SUMMARY OF THE INVENTION

The main components of the alarm system of the present invention include a receiver, a transmitter and an adjustable timer. Subcomponents of the system include a light panel inside the receiver that indicates what door/window etc is open, a power pack or plug in unit in the transmitter which provides power to operate the units and transistors and diodes that makes the timing and transmittal.

An example of one application of the alarm system is described in relation to a mailbox. The transmitter/timer is connected to the inside of the mail box and a switch is installed near the mail box door. Both switch and transmitter/timer can be connected by wires or all be in the same unit. As the mail box door is opened, the switch closes, battery power is applied to transmitter/timer and a signal is sent to receiver in the house or wherever. Once the switch is closed after the mail box is opened, and mail is placed inside mail box, and mail door is closed again, the switch will stay closed to continuously, at adjustable preset times, send out the signal to the receiver in the house or wherever. When the mail box owner picks up their mail from the mail box, they reset the closed switch to the open switch position, and close the mail box door to await the next delivery of their mail.

When the transmitter/timer is installed on a door or window, a signal will be sent to receiver as the door and/or window is opened and continuously, at adjustable preset times, send a signal as long as door and/or window is open, to alarm the owner door/window is still open. This will continue until the user rests the closed switch to the open position.

The receiver of the alarm system can either be connected to the power system in the premises or can use a battery pack. Inside the receiver an adjustable IC chip tells a user what their selections are for example talk, bell, chimes or other suitable sound. The transmitter can either have direct power from the power system in the premises or be run by a battery. A switch is used to activate the alarm system. A knob is provided to adjust the timer to send out the signal, a light to indicate that the unit is transmitting at a low signal and needs a battery change. An antenna is built in to the unit.

As soon as a door opens or other aperture that is being monitored sends out an alarm the door etc is open and as long as a door is open it will send out a preset signal every "x" amount of seconds to the receiver saying the door etc is still open and it serve as a reminder.

A more detailed description is included in the drawings that follow.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated.

DESCRIPTION OF THE DRAWING FIGURES

A complete understanding of the present invention may be obtained by reference to the accompanying drawings, when considered in conjunction with the subsequent, detailed description, in which.

For purposes of clarity and brevity, like elements and components will bear the same designations and numbering throughout the Figures.

DETAILED DESCRIPTION OF THE PREFERRED EMBODIMENT OF THE INVENTION

Figure 1:
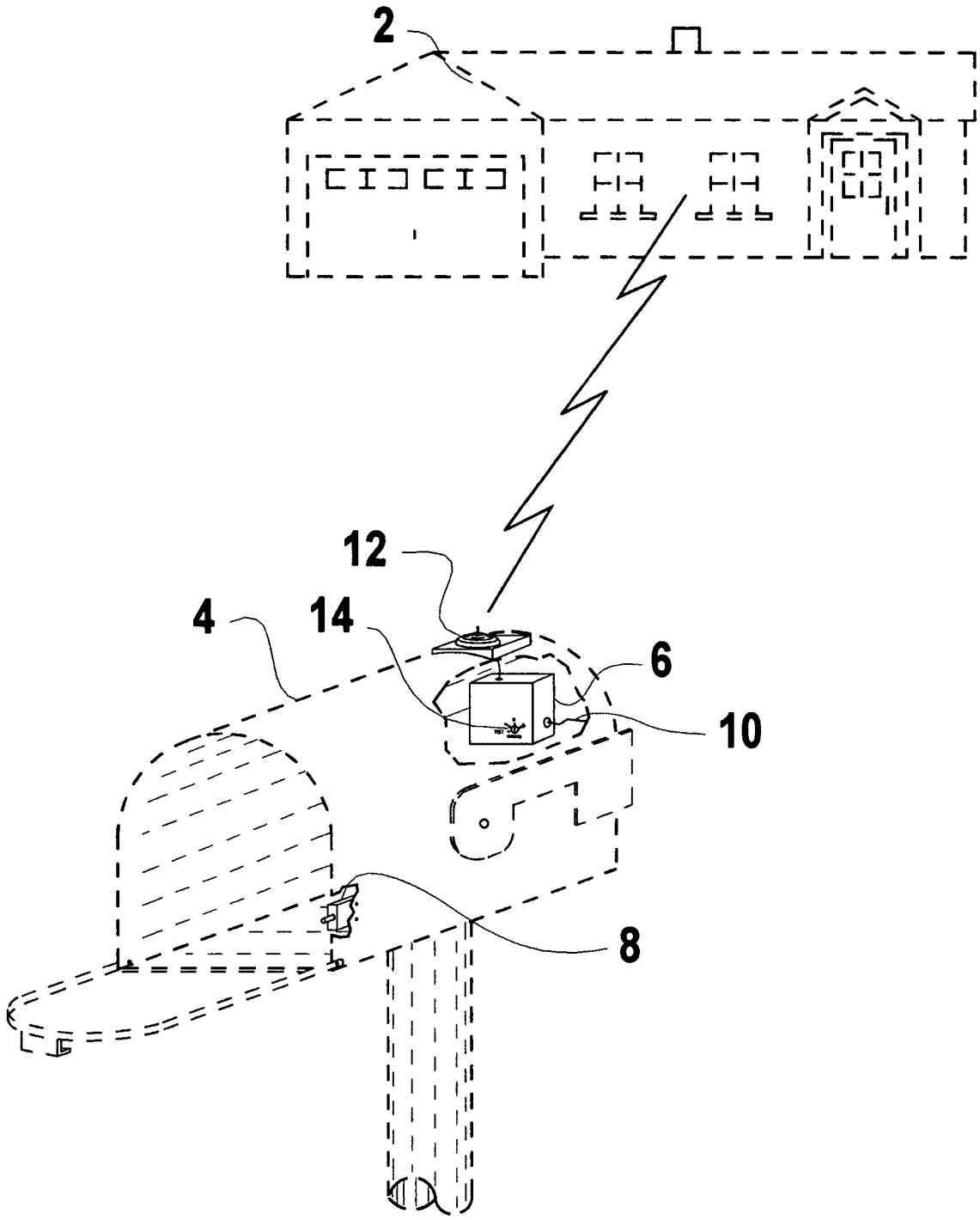
FIG. 1 shows the present invention being used in a mailbox application.

FIG. 1 shows the alarm system of the present invention used in a mailbox application.

The mailbox 4 has a switch 8 mounted near to the opening of the mailbox. Inside the mailbox is placed the transmitter 6. The transmitter 6 is attached to the switch via a connecting wire 10. On the transmitter 6 is an alarm time on and system test potentiometer 14. The alarm signal is sent to a receiver (not shown) in a property 2 via a transmitting antenna 12.

Figure 2:
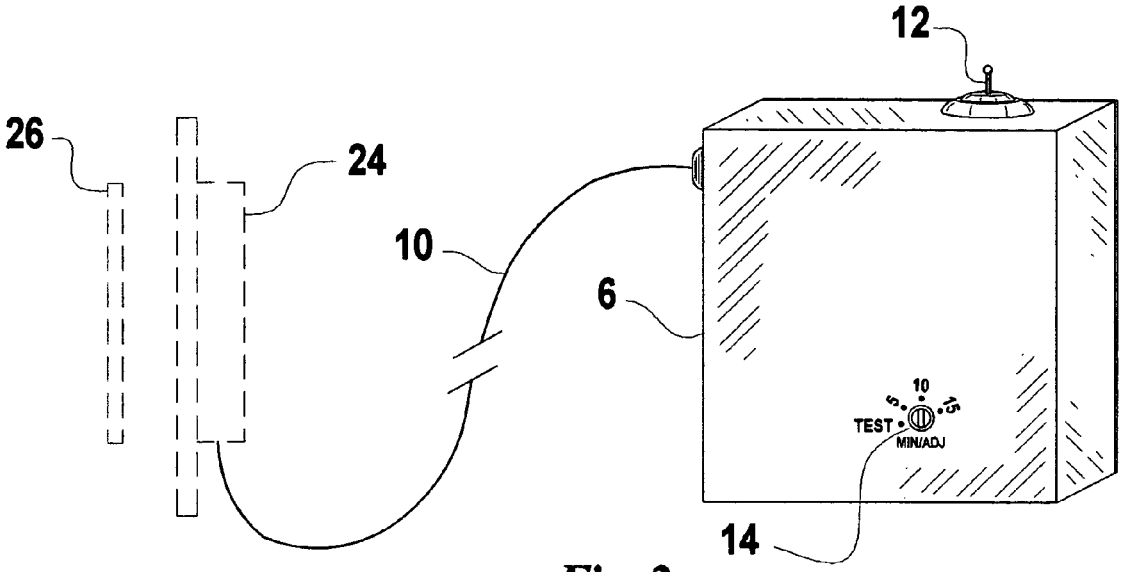
FIG. 2 shows the transmitter part of the present invention.

FIG. 2 shows a view of the transmitter 6 with the transmitting antenna 12 and alarm time on and system test potentiometer 14. The connecting wire 10 leads to a magnetic switch 24 on the for example the front of a mailbox which contacts with a metal switch plate 26 to provide a closed circuit.

Figure 3:
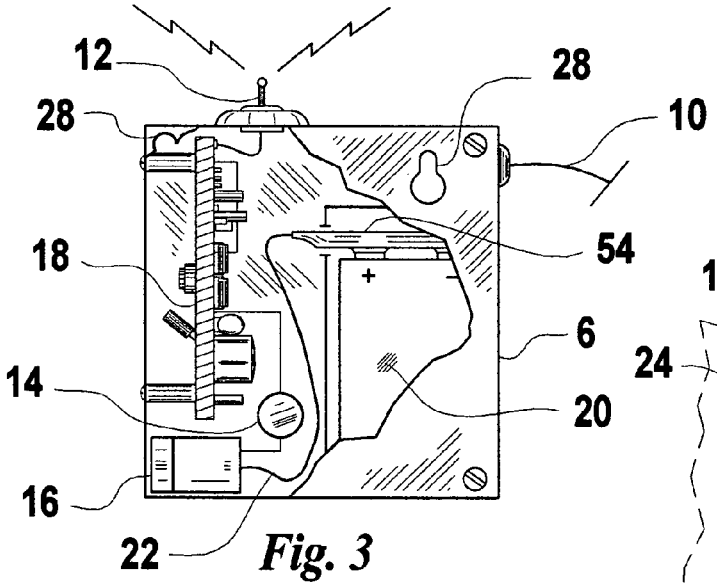
FIG. 3 shows a cut-away view of the transmitter part of the present invention.

FIG. 3 shows the internal portions of the transmitter 6. The transmitting antenna 12 is shown on the top of the unit. Wall mounting holes are shown at 28 for mounting the transmitter on any suitable surface. The transmitter works from a transmitting electronics board 18 which is connected to an alarm time on and system test potentiometer 14 and signal timer 16. The transmitter is powered from a battery 20 through battery connecter wires 22. From the rear of the transmitter is the connecting wire 10 which attaches to a magnetic switch on a suitable aperture.

Figure 4:
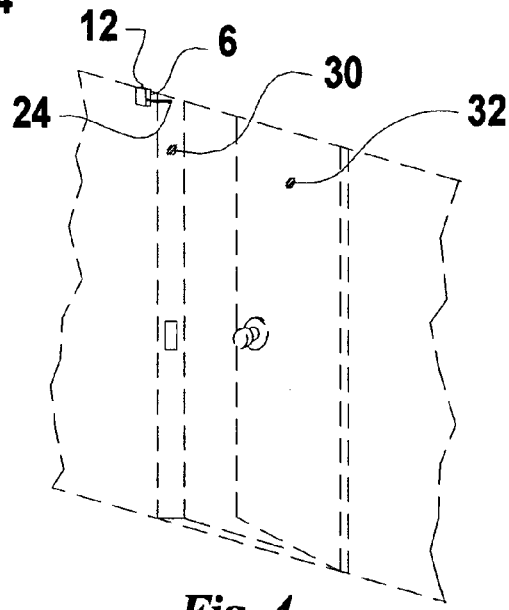
FIG. 4 shows the alarm system of the present invention used in a door application.

FIG. 4 shows the present invention used in a door alarm. The door frame is shown at 30 and an open door 32 which will set off the alarm system. The transmitter 6 is attached at the upper portion of the door frame 30 with transmitting antenna 12 and magnetic switch 24.

Figure 5:
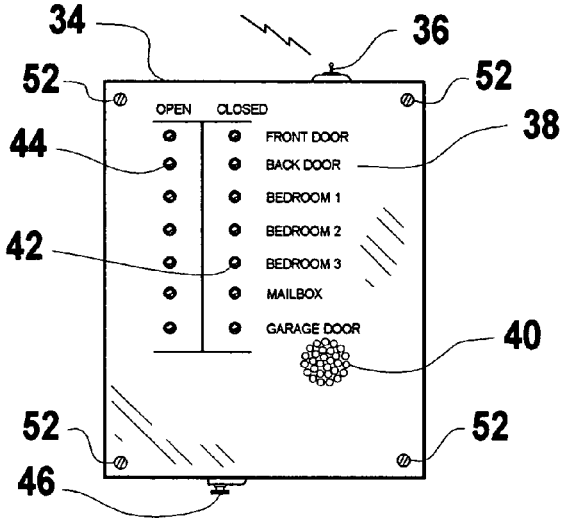
FIG. 5 shows the receiver of the present invention.

FIG. 5 shows the receiver 34. This unit is normally installed internally within a premises. The receiver unit 34 has a receiving antenna 36 normally mounted on the upper surface of the unit. Numeral 52 shows the screw mounting holes. There are two columns of lights 42 and 44, which for example could be red and green, where 44 alerts a user to the fact that a door, mailbox etc is open and 42 alerts a user that a door, mailbox etc is closed. A user can see what alarms are being displayed by user applied decals 38 which display for example front door, back door, bedroom 1 etc. There is a speaker grille 40 which can be used for an audible alert. The receiver is run by a battery and a battery door access knob is shown at 46.

Figure 6:
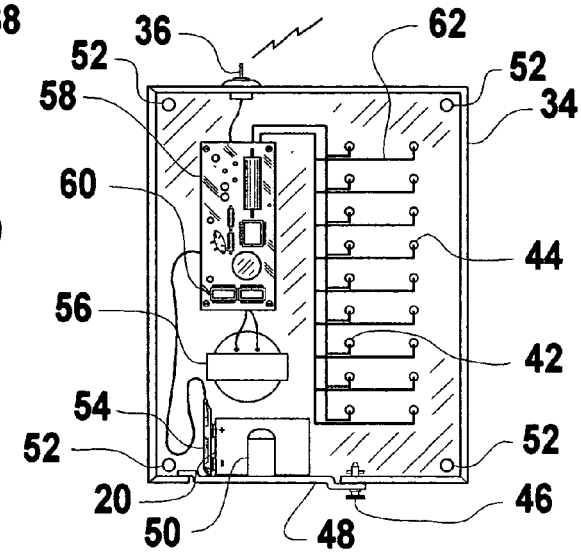
FIG. 6 shows the inside of the receiver of the present invention.

FIG. 6 shows the inside of the receiver 34 having a receiving antenna 36 normally mounted on the upper surface of the unit. Numeral 52 shows the screw mounting holes. There are two columns of lights 42 and 44, which for example could be red and green, where 44 alerts a user to the fact that a door, mailbox etc is open and 42 alerts a user that a door, mailbox etc is closed.

The receiver is run by a battery and a battery door access knob is shown at 46, battery access door is shown at 48, a battery retaining spring clip 50 for a battery 20. A battery connector 54 is connected to a receiver electronics board 58 which contains voice chips 60 with warning announcement facilities. Connected to this board is a speaker 56 and the lights 42 and 44 which are connected via light bulb connecting wires 62.

Figure 7:
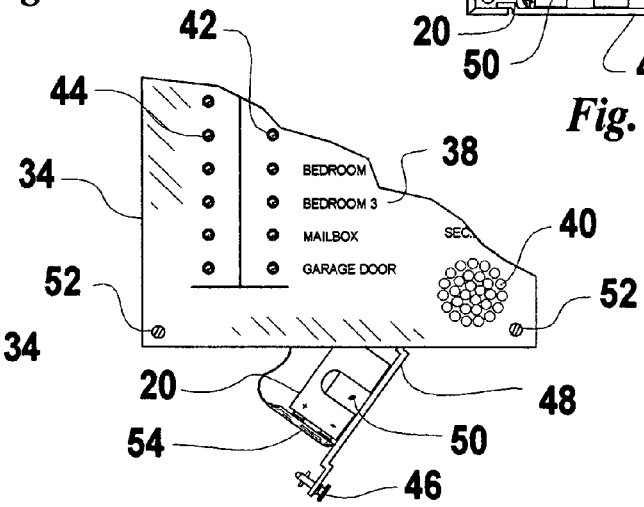
FIG. 7 shows the battery compartment of the receiver of the present invention.

FIG. 7 shows the battery compartment of the receiver in an open position. As in FIG. 5, numeral 52 shows the screw mounting holes. There are two columns of lights 42 and 44, which for example could be red and green, where 44 alerts a user to the fact that a door, mailbox etc is open and 42 alerts a user that a door, mailbox etc is closed. A user can see what alarms are being displayed by user applied decals 38 which display for example front door, back door, bedroom 1 etc. There is a speaker grille 40 which can be used for an audible alert. Referring now to the battery compartment, the battery door access knob 46 is attached to a battery access door 48. The battery 20 is held in place by a battery retaining spring clip 50. The battery is connected to the receiver circuitry by a connector 54.

Figure 8:
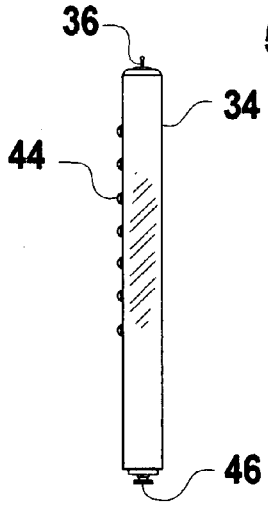
FIG. 8 shows a side view of the receiver of the present invention.

FIG. 8 shows a side view of the receiver 34 This view shows the receiving antenna 36 at the upper end, the column of lights that alert a user that a certain aperture is open and the battery door access knob 46.

Figure 9:
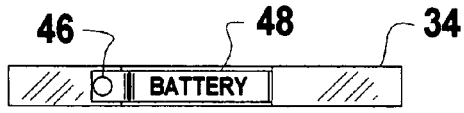
FIG. 9 shows the lower end of the receiver of the present invention.

FIG. 9 shows the lower end of the receiver 34. The battery access door is shown at 48 and the battery door access knob is shown at 46.

With respect to the above description, it is realized that the optimum dimensional relationships for the part of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and change will readily occur to those skilled in the art, it is not desired to limit the invention to the exact construction and operation shown and described, and accordingly, all suitable modifications and equivalents may be resorted to, falling within scope of the invention.

I claim:

1. A mailbox status indicating system used in combination with a mailbox having an aperture for receiving mail, said indicating system comprising:

a contact means secured to the aperture of the mailbox; and a first device and a second device; said first device comprising a switch and a transmitter unit; said switch is electrically coupled to the transmitter unit; wherein the switch is mounted in close proximity to the aperture of the mailbox and aligned with the contact means; said second device comprising a receiver unit and a warning means for sounding or displaying a warning signal; said receiver unit is electrically coupled to said warning means; said second device is used for reminding a user to check and close the mailbox when opened; and said second device is located away from the mailbox and in a close proximity to a user's active area such that the user could see or hear a warning signal from the warning means easily; wherein said second device is only activated upon sensing the presence of the user by motion sensor; said transmitter unit includes a transmitting means for transmitting signals and said receiver unit includes a receiving means for receiving said transmitted signals and said contact means contacts and closes said first switch when mailbox is in an opened position for rendering current to travel to said transmitter unit, said transmitter unit transmits said signals to said receiver unit, and said received signals are received via said receiving means for activating said warning means; said transmitter unit comprises a timer device that enables the transmitter unit to send out a preset signal repeatedly every predetermined amount of seconds to the receiver indicating to the user that the mailbox is still open and serves as a reminder.

2. A mailbox status indicating system as in claim 1 wherein said transmitting means is a signal generator.

3. A mailbox status indicating system as in claim 1 wherein said receiving means is a radio frequency receiver.

4. A mailbox door status indicating system as in claim 3 wherein said receiving means is a radio frequency receiver.

5. A mailbox door status indication system as in claim 1, wherein said contact means is a mailbox door switch bracket, and said mailbox door switch bracket is vertically aligned with said first switch.

6. A mailbox door status indication system as in claim 1, wherein said warning means can be visual for example a series of lights and/or audible for example a voice signal, a bell or a chime or any other suitable sound.

7. A window status indicating system used in combination with a window which is situated in an aperture, said system comprising:

a contact means secured to the aperture of the window; and a first device and a second device; said first device comprising a switch and a transmitter unit; wherein the switch is mounted in close proximity to the aperture of the window and aligned with the contact means; said second device comprising a receiving unit and a warning means for sounding or displaying a warning signal; said receiver unit is electrically coupled to said warning means; said second device is used for reminding user to check and close the opened window; and said second device is located away from the window and in close proximity to a users' active area such that the user could see or hear a warning signal from the warning means easily; wherein said second device is only activated upon the sensed presence of the user by a motion sensor; said transmitter unit includes a transmitting means for transmitting signals and said receiver unit includes a receiving means for receiving said transmitted signals; said contact means contacts and closes said first switch when said window is in an opened position for rendering current to travel to said transmitter unit, said transmitter unit transmits said signals to said receiver unit, and said received signals are received via said receiving means for activating said warning means; said transmitter unit comprises a timer device that enables the transmitter unit to repeatedly send out a preset signal every predetermined amount of seconds to the receiver indicating to the user that the window is still open and serves as a reminder.

8. A window status indication system as in claim 7 wherein said transmitting means is a signal generator.

9. A window status indication system as in claim 7 wherein said receiving means is a radio frequency receiver.

10. A window status indication system as in claim 9 wherein said receiving means is a radio frequency receiver.

11. A window status indication system as in claim 7 wherein said contact means is a bracket, and said bracket is vertically aligned with said first switch.

12. A window status indication system as in claim 7 wherein said warning means can be visual for example a series of lights and/or audible for example a voice signal, a bell or a chime or other suitable sound.

13. A door status indication system used in combination with a door which is situated in an aperture, said indicating system comprises; a contact means secured to the aperture of the door, and a first device and a second device, said first device comprising a switch and a transmitter unit; said switch is electrically coupled to the transmitter unit; wherein the switch is mounted in close proximity to the aperture of the door and aligned with the contact means; said contact device comprising a receiving unit and a warning means for sounding or displaying a warning signal; said second device is used for reminding a user to check and close the opened door; and said second device is located away from the door and in close proximity to a user's active area such that the user could see or hear a warning signal from the warning easily; wherein said second device is only activated upon the sensing the presence of the user by a motion sensor; said transmitter unit includes a transmitting means for transmitting signals and said receiver unit includes a receiving means for receiving said transmitted signals said contact means contacts and closes said first switch when said door is in an open position for rendering a current to travel to said transmitter unit, said transmitter unit transmits said signals to said receiver unit, and said received signals are received via said receiving means for activating said warning means; said transmitter unit comprises a timer device that enables the transmitter unit to repeatedly send out a preset signal every predetermined amount of seconds to the receiver saying the door is still open and serves as a reminder.

14. A door status indicating system as in claim 13 wherein said transmitting means is a signal generator.

15. A door status indicating system as in claim 13 wherein said receiving means is a radio frequency receiver.

16. A door status indicating system as in claim 15 wherein said receiving means is a radio frequency receiver.

17. A door status indicating system as in claim 13 wherein said contact means is a door switch bracket, and said door switch bracket is vertically aligned with said first switch.

18. A door status indicating system as in claim 13 wherein said warning means can be visual for example a series of lights and/or audible for example a voice signal, a bell or a chime or other suitable sound.

* * * * *